US005151556A

United States Patent [19]

Maher et al.

[11] Patent Number: 5,151,556

[45] Date of Patent: Sep. 29, 1992

[54] PROPELLANT MAGAZINE FOR FIELD ARTILLERY PIECE

[75] Inventors: David L. Maher, Hero; Callista M. Rodriquez, Milton; Paul A. Trahan, St. Albans, all of Vt.

[73] Assignee: General Electric Company, Burlington, Vt.

[21] Appl. No.: 633,702

[22] Filed: Dec. 24, 1990

[51] Int. Cl.[5] ..... F42B 39/08

[52] U.S. Cl. ..... 89/35.01; 89/33.16; 198/803.13; 198/803.15; 198/853

[58] Field of Search ..... 89/35.01, 35.02, 46, 89/33.14, 33.16; 198/817, 850, 853, 803.13, 803.14, 803.15, 803.12; 221/84

[56] References Cited

U.S. PATENT DOCUMENTS

| | | | |
|---|---|---|---|
| 1,376,354 | 4/1921 | Peoples | 89/35.01 |
| 3,501,996 | 3/1970 | Lipp et al. | 89/46 |
| 3,527,015 | 9/1970 | Aronson et al. | 198/803.15 |
| 3,770,106 | 11/1973 | Kuehl et al. | 198/853 |
| 4,050,323 | 9/1977 | I'Anson | 198/853 |
| 4,137,820 | 2/1979 | Clemens | 89/33.14 |
| 4,487,104 | 12/1984 | Schiele et al. | 89/34 |
| 4,790,231 | 12/1988 | Stoner | 89/35.02 |
| 4,939,980 | 7/1990 | Zielinski | 89/46 |

FOREIGN PATENT DOCUMENTS

| | | | |
|---|---|---|---|
| 41260 | 3/1910 | Austria | 89/35.02 |
| 670698 | 6/1989 | Switzerland | 89/35.01 |

*Primary Examiner*—Stephen Johnson

*Attorney, Agent, or Firm*—Bailin L. Kuch; Robert A. Cahill

[57] ABSTRACT

A propellant magazine includes a conveyor for mechanizing the handling of propellant charge units into and out of magazine storage. The charge units are contained in open ended tubular packs which are loaded onto the conveyor at a resupply loading station and are axially discharged from the packs through one open end at a gun loading station. The conveyor is comprised of a series of transversely elongated conveyor elements having a pair of hoops at each end with hoops of each adjacent pair of elements retained in nested relation to pivotally interconnect the elements in chain link fashion. The propellant charge units are discharged axially through the nested hoops along one side of the conveyor.

9 Claims, 4 Drawing Sheets

FIG. 3
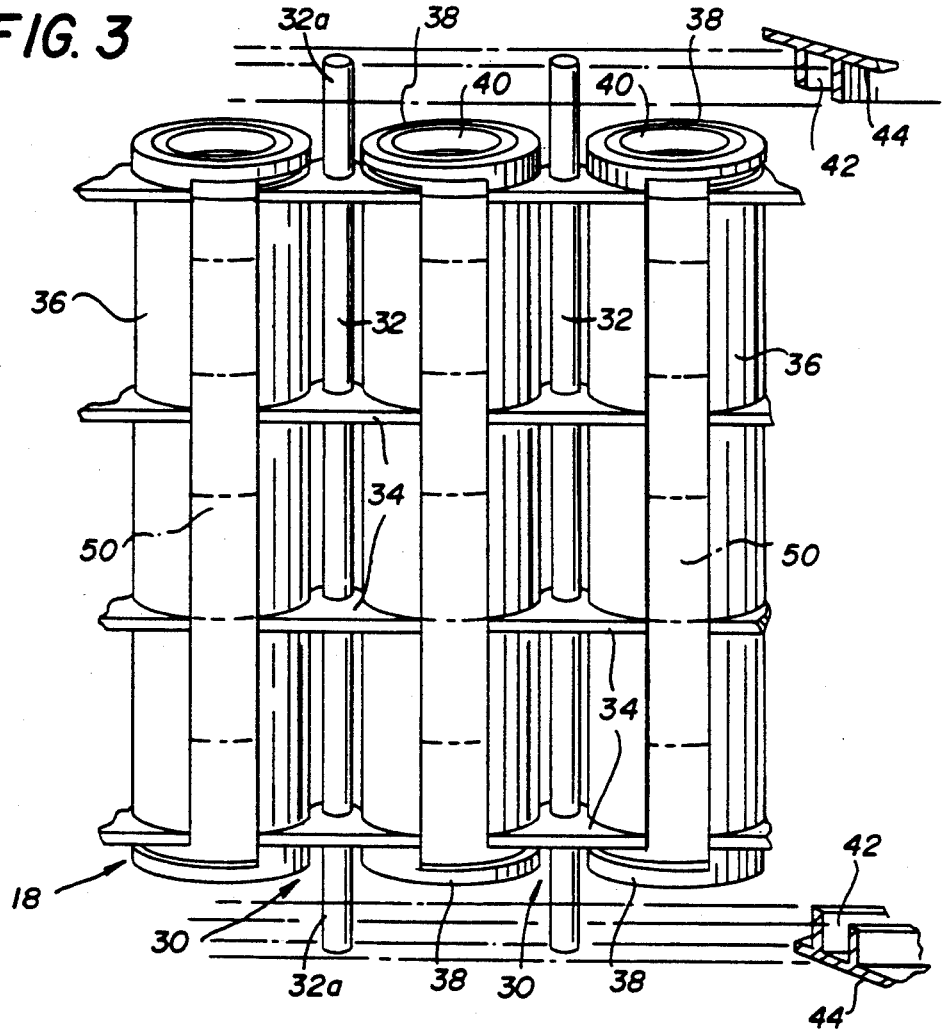
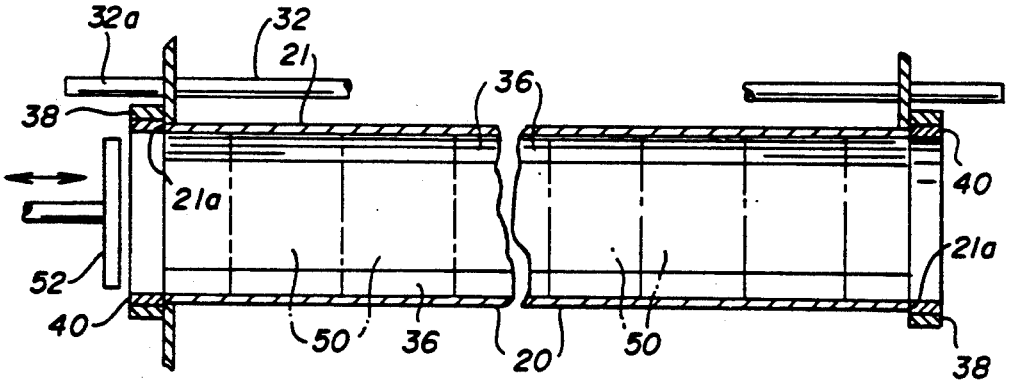
FIG. 6

PROPELLANT MAGAZINE FOR FIELD ARTILLERY PIECE

The present invention relates to ammunition magazines and particularly to magazines accommodating automated loading and resupply of propellant charges for large artillery pieces.

BACKGROUND OF THE INVENTION

Heretofore, the task of handling ammunition for large caliber artillery pieces has been highly labor intensive and time consuming. In the case of howitzers, an ammunition round is typically comprised of two components, a projectile and a propellant, which are stored and handled separately. To load a howitzer, a projectile is manually inserted in the gun breech, followed by the propellant charge, typically packaged in bags. The bags are segmented like a string of sausages and the loader typically must remove unwanted segments to provide the correct propellant charge or zone. Under these circumstances, the firing rate is quite slow. Resupplying an artillery piece is also a slow procedure. In the case of a mobile or self-propelled howitzer, for example, projectiles and propellant charges must be manually transferred from a field ammunition depot or resupply vehicle and stowed in separate magazines.

To reduce the number of military personnel required and to save time, both in terms of resupplying and loading artillery pieces, it has been proposed to provide automated handling equipment for feeding ammunition into a magazine for storage, maintaining the ammunition in a safe and secure magazine storage location, and subsequently feeding the ammunition out of the magazine to the gun for firing. Except for their typically greater size and weight, projectiles are reasonably analogous to cartridged ammunition rounds, and thus approaches utilized heretofore in the automated magazine handling of cartridge rounds can be adapted to projectile magazine handling. This is not the case with respect to propellant charges which present altogether different automated handling considerations. The traditional bag propellant, due to its unique physical characteristics, does not readily lend itself to automated handling.

SUMMARY OF THE INVENTION

It is accordingly an object of the present invention to provide a magazine serving a large caliber artillery gun and equipped to handle propellant charges on an automated basis.

A further object is to provide a propellant magazine of the above character, which includes a conveyor for automatically conveying propellant charges into and out of magazine storage.

Another object is to provide a propellant magazine of the above-character, wherein the conveyor is adopted to present propellant charges at a gun loading station in a manner accommodating automated loading into the gun.

A still further object is to provide a propellant magazine of the above-character, wherein the conveyor is adapted to accept propellant charges presented at a resupply loading station and convey the resupplied propellant charges into magazine storage positions on an automated basis.

An additional object is to provide a propellant magazine of the above-character, which is simple and economical in construction, compact in size, and reliable in operation.

Other objects of the invention will in part be obvious and in part appear hereinafter.

In accordance with the present invention, there is provided a propellant magazine uniquely adapted to serve a large caliber artillery piece, such as a self-propelled howitzer, on an automated basis. The magazine includes an internal, endless conveyor trained in a serpentine path through a resupply loading station, where units of propellant charge encased in turbular packs are loaded onto the conveyor, and a gun loading station, where propellant charge units are loaded into the weapon, all in mechanized fashion. The conveyor is comprised of modular, pivotally interconnected conveyor elements having retaining features capable of accepting transverse handoffs of propellant packs while moving through the resupply loading station located at a turnaround in the conveyor serpentine path. The conveyor elements thereafter maintain positional control of the propellant packs while being conveyed through and stored in the magazine. The pivotal interconnections of the conveyor elements at each side of the conveyor are in the form of nested hoops, such as to expose open ends of the propellent packs and thus to accommodate axial transfer of appropriate numbers of propellant charge units from the packs to the howitzer loading mechanism when conveyed to the loading transfer station.

The invention accordingly comprises the features of construction, combination of elements, and arrangement of parts, all as described herein below, and the scope of the invention will be indicated in the claims.

BRIEF DESCRIPTION OF THE DRAWINGS

For a full understanding of the nature and objects of the present invention, reference may be had to the following Detailed Description taken in connection with the accompanying drawings, in which:

FIG. 3 is a perspective view of a portion of the propellant conveyor of FIG. 2;

FIG. 6 is a side view illustrating the transfer of propellant charge units from the conveyor of FIGS. 2 and 3 at a gun loading station.

Corresponding reference numerals refer to like parts throughout the several views of the drawings.

DETAILED DESCRIPTION

Figure 1:
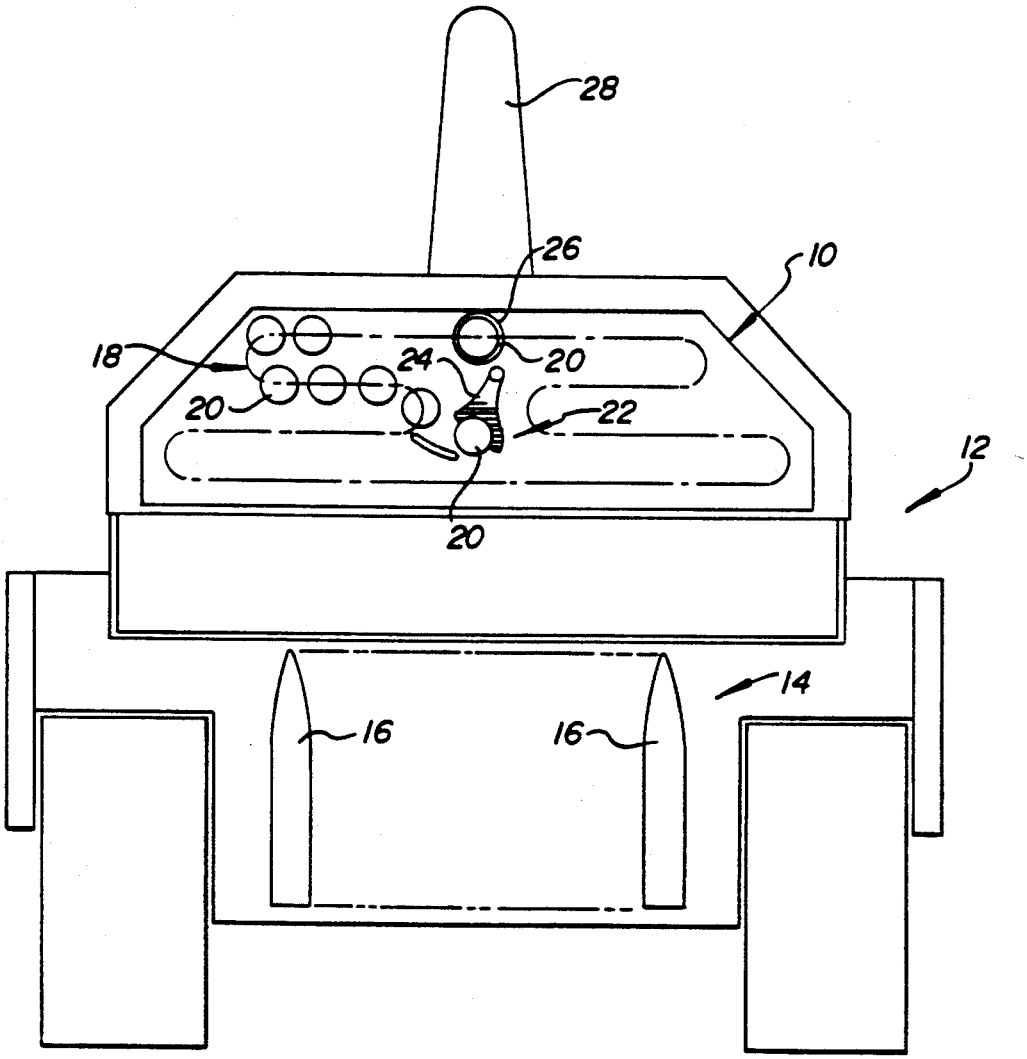
FIG. 1 is a rear view of a self-propelled howitzer equipped with a propellant magazine constructed in accordance with the present invention.

The propellant magazine of the present invention, generally indicated at 10 in FIG. 1, is illustrated in its application to a large caliber artillery piece, such as a self-propelled howitzer, generally indicated at 12. The howitzer also contains a magazine, generally indicated at 14, for storing projectiles 16. The projectile magazine is not a part of the present invention and hence is illustrated only in cryptic fashion. Propellant magazine 10 includes a conveyor, generally indicated at 18, on which propellant packs 20 are accommodated in horizontal orientation for conveyance in an endless, serpentine path throughout the magazine interior. A resupply loading station, generally indicated at 22, is located at a turnaround (180° turn) in the serpentine conveyor path where loaded propellant packs 20 serially presented from a resupply source (not shown) are laterally handed off to the conveyor by a transfer mechanism 24. A gun loading station, generally indicated at 26, is located at a position in a straight run of the conveyor proximate the breech end of the howitzer barrel 28 where units of propellant charge are advanced axially out of individual propellant packs 20 to a gun loading mechanism (not shown).

Figure 2:
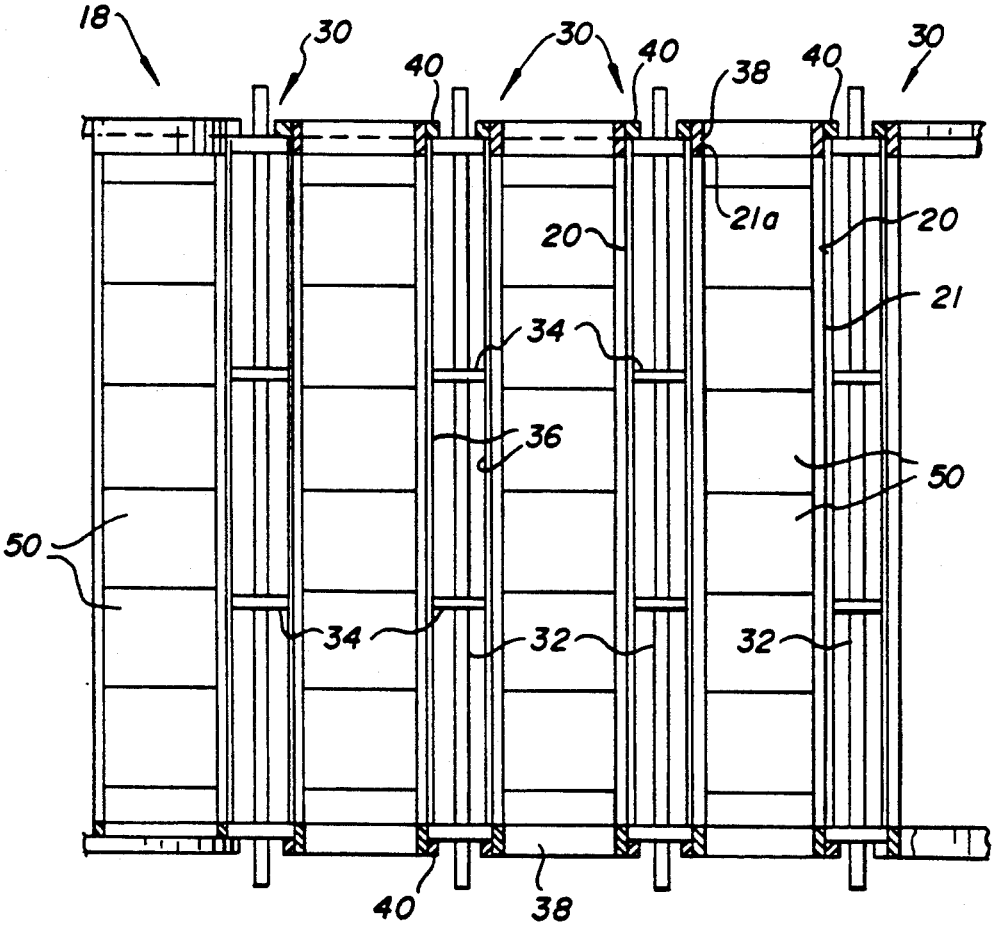
FIG. 2 is a fragmentary sectional view of a propellant conveyor incorporated in the propellant magazine of FIG. 1.
Figure 4:
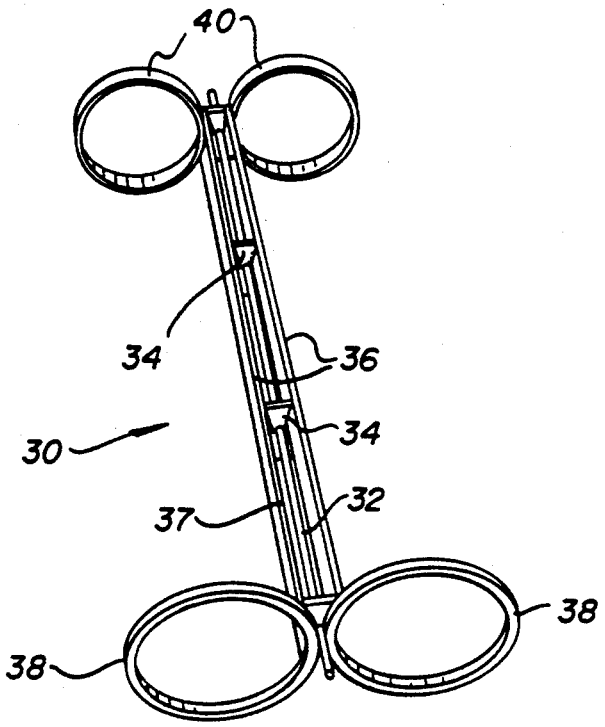
FIG. 4 is a perspective view of one of the modular conveyor elements utilized in the assembly of the propellant conveyor of FIGS. 2 and 3.

As seen in FIGS. 2 and 3, conveyor 18 consists of a series of pivotally interconnected, modular conveyor elements, generally indicated at 30, each of the construction best seen in FIG. 4. Each conveyor element consists of an elongated central rod 32 to which are affixed, such as by welding, a plurality of brackets 34, one adjacent each end and at least one other at an intermediate point. These brackets, extending laterally to each side of rod 32, serve to mount a pair of elongated, clamshell retainers 36 having oppositely faced, arcuate retaining surfaces 37 conforming to the cylindrical surface of propellant packs 20. The bracket adjacent one rod end also mounts a pair of large hoops 38 in side-by-side relation to resemble an eyeglass frame. A pair of small hoops 40 are affixed to the bracket 34 adjacent the other rod end in corresponding side-by-side relation. The inner diameter of each hoop 38 is slightly larger than the outer diameter of each hoop 40.

To assemble conveyor 18 from conveyor elements 30, the elements are serially arranged in alternating end-for-end orientations, with the hoops 40 at one end of each element nested in a hoop 38 at the corresponding ends of the adjacent elements to each side. It is thus seen that, as long as the hoops 38 and 40 at both ends of the conveyor elements are maintained in nested relation, the conveyor elements are pivotally interconnected in chain link fashion. To this end and as seen in FIG. 3, the rod ends **32*a* extending beyond the hoops of each conveyor element run in guide tracks 42 carried by opposed sidewalls 44 of magazine 10** to thereby constrain the conveyor elements against endwise relative movements tending to un-nest the hoops. It will be appreciated that these guide tracks extend in flanking relation with the conveyor throughout its serpentine path to maintain positive control and guidance over the individual conveyor elements.

Still referring to FIGS. 2 and 3, it is seen that the propellant packs 20 are held on conveyor 18 in conveyor positions between clamshell retainers 36 of each neighboring pair of conveyor elements 30. The diametrically opposed retaining surfaces 37 of these retainers confronting each conveyor position bear against the propellant pack periphery over sufficient arcs to secure the propellant packs in their conveyor positions while in stationary magazine storage positions and while moving along the serpentine conveyor path. As seen in FIGS. 2 and 6, lateral retention of the propellant packs in their conveyor positions is provided by the small hoops 40 whose inner diameter conforms to the inner diameter of the propellant pack tubular casing 21. These hoops closely confront the casing edge surface **21*a* at each end of a propellant pack (FIG. 6**) to preclude endwise movement thereof.

At the turnaround where resupply loading station 22 (FIG. 1) is located, the retainers for each conveyor position swing away from their normal diametrically opposed relationship prevailing in the straight run portions of the conveyor path to, in effect, open up to accept lateral handoff of a loaded propellant pack into a conveyor position from transfer mechanism 24 and to permit handoff of an empty propellant pack from a conveyor position to the transfer mechanism. Once a conveyor position leaves resupply transfer station, the clamshell retainers close into diametrically opposed relation with a loaded propellant pack to secure it in its conveyor position. At the other turnarounds, magazine-mounted turnaround guides (not shown) are provided to retain propellant packs in their conveyor positions while the clamshell retainers are opened up.

Figure 5:
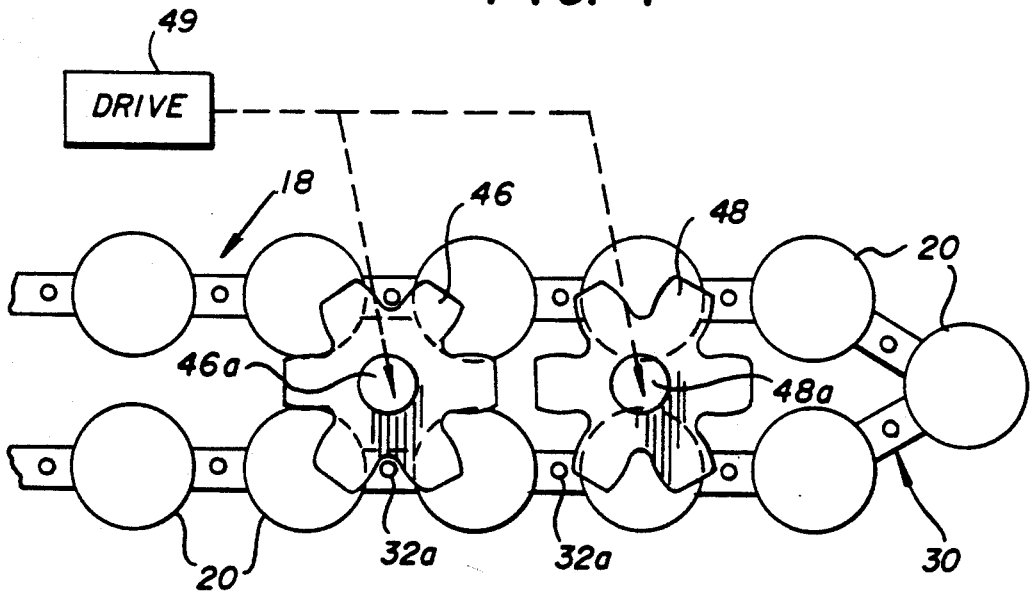
FIG. 5 is a fragmentary side view of a portion of the propellant conveyor of FIGS. 2 and 3.

As seen in FIG. 5, conveyor 20 is driven by drive sprockets 46 and 48 arranged in sets located to each side of the conveyor adjacent each serpentine path turnaround. The drive sprockets 46 and 48 of each set are relatively phased in their angular positions fixed on respective shafts **46*a* and 48*a* commonly driven by means schematically indicated at 49, such that they alternate their driving engagements with rod ends 32*a* which conveniently serve as drive pegs. Thus, as seen in FIG. 4, sprocket 46 is driving engaging rod ends, while sprocket 48 is not. As the former rotates out of driving engagement with the rod ends, the latter rotates into driving engagement with the rod ends. Thus the sprockets 46 and 48** of each set alternate in driving the conveyor.

This conveyor driving arrangement permits the spacing between adjacent straight runs of the serpentine conveyor path to be minimized and thus provides a high packing density of propellant packs 20 in magazine 10. Since the rod ends **32*a* are spaced at a pitch of one conveyor position, a single drive sprocket would necessarily have to be of a significantly larger diameter than sprockets 46, 48, to maintain uninterrupted driving engagement with the conveyor. A larger drive sprocket means greater spacing between adjacent parallel straight runs of the conveyor. By phasing sprockets 46 and 48 one-half conveyor position pitch apart, one of the other of these sprockets of each set is always drivingly engaging the conveyor. As a consequence, high propellant packing storage density is achieved, despite the fact that drive pegs intermediate rod ends 32*a*** and axially aligned with the ends of the propellant packs have been eliminated.

As seen in FIGS. 2 and 6, each propellant pack 20 contains a column of propellant charge units 50, each consisting of a quantity of granular propellant confined in a combustible, nitrate impregnated cardboard case. To load propellant into howitzer 12 from a propellant pack presented at gun loading station 26, a pusher 52 (FIG. 6) is activated to extend into the open rear end of the propellant pack casing 21 and push an appropriate number of propellant charge units 50 axially out the open front end thereof into the howitzer propellant loading mechanism (not shown). This axial gun loading operation is possible due to the hooped link construction of the conveyor elements. It will be appreciated that conveyor guide tracks 42 (FIG. 3) are interrupted at the loading transfer station 26 to accommodate reciprocation of pusher 52 and axial discharge of propellant charge units 50 from the propellant packs. The propellant pack is retained in place as the charge units are discharged by engagement of the front casing edge **21*a* against a small conveyor element hoop 40, as seen in FIG. 6**. Suitable means (not shown) are provided with the propellant packs to axially restrain the charge units therein when not being discharged.

From the foregoing, it is seen that the objects set forth above, including those made apparent from the Detailed Description, are efficiently attained, and, since certain changes may be made in the details set forth without departing from the scope of the invention, it is intended that matters of detail be taken as illustrative and not in limiting sense.

Having described the invention, what is claimed as new and desired to secure by Letters Patent is:

1. A chain conveyor for articles comprising a series of modular conveyor elements, each said conveyor element comprising:

A. an elongated member;

B. a pair of first hoops affixed to said member adjacent one end thereof;

C. a pair of second hoops affixed to said member adjacent the other end thereof, said second hoops having an outer diameter slightly less than the inner diameter of said first hoops;

D. said conveyor elements being arranged in alternating end-for-end orientations with said second hoops nested in said first hoops at each end of each adjacent pair of said conveyor elements, whereby to pivotally interconnect said conveyor elements.

2. The chain conveyor defined in claim 1, wherein each said conveyor element further includes a pair of retainers mounted to said member in opposed relation for engaging articles in conveyor positions between adjacent pairs of said conveyor elements.

3. The chain conveyor defined in claim 2, which further includes means for unloading articles from said conveyor positions axially through said nested first and second hoops.

4. The chain conveyor defined in claim 3, wherein said member has terminal ends extending beyond said pairs of first and second hoops to provide sprocket engaging drive pegs uniformly distributed along the sides of said conveyor.

5. The chain conveyor defined in claim 4, which further includes opposed guide tracks, said drive pegs riding in said guide tracks to guide said conveyor along a predetermined conveyor path and to maintain the nested relation of said first and second hoops.

6. The chain conveyor defined in claim 5, wherein said predetermined conveyor path is an endless, serpentine path having closely spaced, generally straight line sections interconnected by turnaround sections, said chain conveyor further including plural sets of first and second, side-by-side sprockets positioned between said straight line conveyor path sections, said first and second sprockets being driven in common, relatively phased relation such that said first and second sprockets alternate in drivingly engaging said drive pegs.

7. The chain conveyor defined in claim 6, wherein the articles are open ended, tubular propellant packs, each containing plural propellant charge units, and wherein said retainers are of a clamshell configuration, said retainers of adjacent pairs of said conveyor elements assuming diametrically opposed relative positions during movement through said straightline sections to retain said propellant packs in said conveyor positions and swinging to open relative positions during movement through said turnaround sections to admit the lateral transfer into said conveyor positions of said propellant packs from a resupply loading station located at one of said turnaround sections.

8. The chain conveyor defined in claim 7, wherein a gun loading station is positioned at a point along one of said straightline sections, and wherein the inner diameter of said second hoops is of a dimension to permit the penetration of pusher mean through said second hoops at one side of said conveyor and into said propellant packs upon presentation at said gun loading station and to permit the discharge of propellant charge units from said propellant packs through said second hoops at the other side of said conveyor and into said gun loading station.

9. The chain conveyor defined in claim 8, wherein said propellant packs are constrained against endwise movements in said conveyor positions by said second hoops of each said nested pair of first and second hoops.

* * * * *